US007947150B2

(12) United States Patent
Gabriels

(10) Patent No.: US 7,947,150 B2
(45) Date of Patent: May 24, 2011

(54) MULTI-PLY ROLLED PAPER SEPARATING DEVICE AND METHOD OF USE

(76) Inventor: Firmin Forrest Gabriels, Albany, NY (US)

( * ) Notice: Subject to any disclaimer, the term of this patent is extended or adjusted under 35 U.S.C. 154(b) by 292 days.

(21) Appl. No.: 12/127,294

(22) Filed: May 27, 2008

(65) Prior Publication Data

US 2009/0294058 A1 Dec. 3, 2009

(51) Int. Cl.
*B29C 63/00* (2006.01)
*B65H 16/00* (2006.01)

(52) U.S. Cl. ..... 156/344; 156/584; 206/389; 242/550

(58) Field of Classification Search ..... 156/344, 156/584; D06/523; 242/550–566; 206/389–417
See application file for complete search history.

(56) References Cited

U.S. PATENT DOCUMENTS 4,191,317 A 3/1980 Harkins
5,054,676 A 10/1991 Ban
5,484,119 A 1/1996 Olive
5,845,870 A 12/1998 Angle
6,267,322 B1 * 7/2001 Harmathy ..... 242/595
6,345,797 B1 * 2/2002 Ming-Hsiao ..... 248/309.2
6,405,971 B1 6/2002 Trecartin
6,450,439 B1 9/2002 van Rees
6,460,799 B1 10/2002 Ryan
6,508,432 B2 1/2003 Krivulin
6,926,308 B2 * 8/2005 Penn et al. ..... 283/56

* cited by examiner

*Primary Examiner* — Khanh Nguyen
*Assistant Examiner* — Carson Gross
(74) *Attorney, Agent, or Firm* — John W. Boger; Heslin Rothenberg Farley & Mesiti P.C.

(57) ABSTRACT

A device for use in connection with a multi-ply rolled paper holder to separate multi-ply rolled paper into distinct individual plies. The device includes at least one arm and at least one member. Each arm has an upper end portion that is configured to releasably couple to a multi-ply rolled paper holder and a lower end portion that couples to the at least one member. The overall length L of the arm may be of a fixed length or may be adjustable through a telescoping or sliding mechanism. Each member has two ends, and a top surface and a bottom surface. When operatively positioned relative to the multi-ply rolled paper holder, the configuration of the member functions to divide the multi-ply rolled paper into the individual plies. A method of use and of assembly of the multi-ply rolled paper separating device are also disclosed.

12 Claims, 4 Drawing Sheets

MULTI-PLY ROLLED PAPER SEPARATING DEVICE AND METHOD OF USE

FIELD OF THE INVENTION

The present invention relates generally to a device for separating rolled paper. More particularly, the present invention is used with a conventional multi-ply rolled paper holder to separate multi-ply rolled paper into separate and distinct plies.

BACKGROUND OF THE INVENTION

Human consumption of paper products creates devastating effects on the forests in the United States and other countries, and contributes to the rapid growth of increasingly unmanageable landfills.

For example, the excessive use of paper products, such as multi-ply rolled toilet paper, can create serious plumbing problems affecting municipal sewage systems, drainpipes, and/or septic tanks. Using single ply rolled paper products is a simple solution to the associated stress that is placed on septic and sewage systems by multi-ply paper products.

BRIEF SUMMARY OF THE INVENTION

The multi-ply rolled paper separating device provides a solution to these identified problems. Consumers will save money by purchasing less expensive multi-ply rolled paper product, yet extending its use life by at least double. In addition, the use of the multi-ply rolled paper separating device will result in the consumer encountering less sewage and septic problems that are caused by multi-ply rolled paper construction. Furthermore, the device is easy to use and install, and can be used in residential, commercial and public environments.

In accordance with the illustrated embodiment, the multi-ply rolled paper separating device has at least one member and at least one arm. Each member has a first end and a second end, with a longitudinal axis that extends between the two ends, and a top surface and a bottom surface that are parallel to the longitudinal axis. Each arm has an upper end portion that attaches to the multi-ply rolled paper holder through a releasable securement mechanism, and a lower end portion that is configured to couple to one of the two ends of the member. When the multi-ply rolled paper separating device is placed on the multi-ply rolled paper holder, the member acts to divide the multi-ply rolled paper by individual plies being passed over the top surface and over the bottom surface of the member.

There is also provided a method for using the multi-ply rolled paper separating device. The multi-ply rolled paper separating device includes at least one member and at least one arm. Each member has a first end and a second end, with a longitudinal axis extending between the two ends, and a top surface and a bottom surface, that are parallel to the longitudinal axis. Each arm has an upper end portion that attaches to the multi-ply rolled paper holder through a releasable securement mechanism, and a lower end portion that is configured to couple to one of the two ends of the member. Additionally, the method includes placing multi-ply rolled paper on the multi-ply rolled paper holder and separating the multi-ply rolled paper with the member into individual plies by passing a first ply over the top surface and a second ply passing over the bottom surface.

Also described herein is a method for assembling the multi-ply rolled paper separating device. The method includes securing the at least one arm to the at least one member. Each member has a first end and a second end, with a longitudinal axis extending between the two ends, and has a top surface and a bottom surface that are parallel to the longitudinal axis. Each arm has an upper end portion that is secured to the multi-ply rolled paper holder, and a lower end portion that is configured to couple to one of the two ends of the member. The method further includes securing the upper end portions of each arm to one of the two ends of the multi-ply rolled paper holder, such that when the multi-ply rolled paper separating device is placed on the multi-ply rolled paper holder, each member acts to divide the multi-ply rolled paper into individual plies by passing a first ply over the top surface and a second ply over the bottom surface of the member.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention are apparent from the following detailed description taken in conjunction with the accompanying drawings in which:

BEST MODE FOR CARRYING OUT THE INVENTION

The following detailed description illustrates by way of example and not by way of limitation. Generally stated, disclosed herein is an embodiment of a device that releasably secures to a multi-ply rolled paper product holder to separate a multi-ply rolled paper product, for example, a two-ply rolled toilet paper, into individual plies. Further described herein are a method of use and a method of assembling an embodiment of the device.

Figure 1:
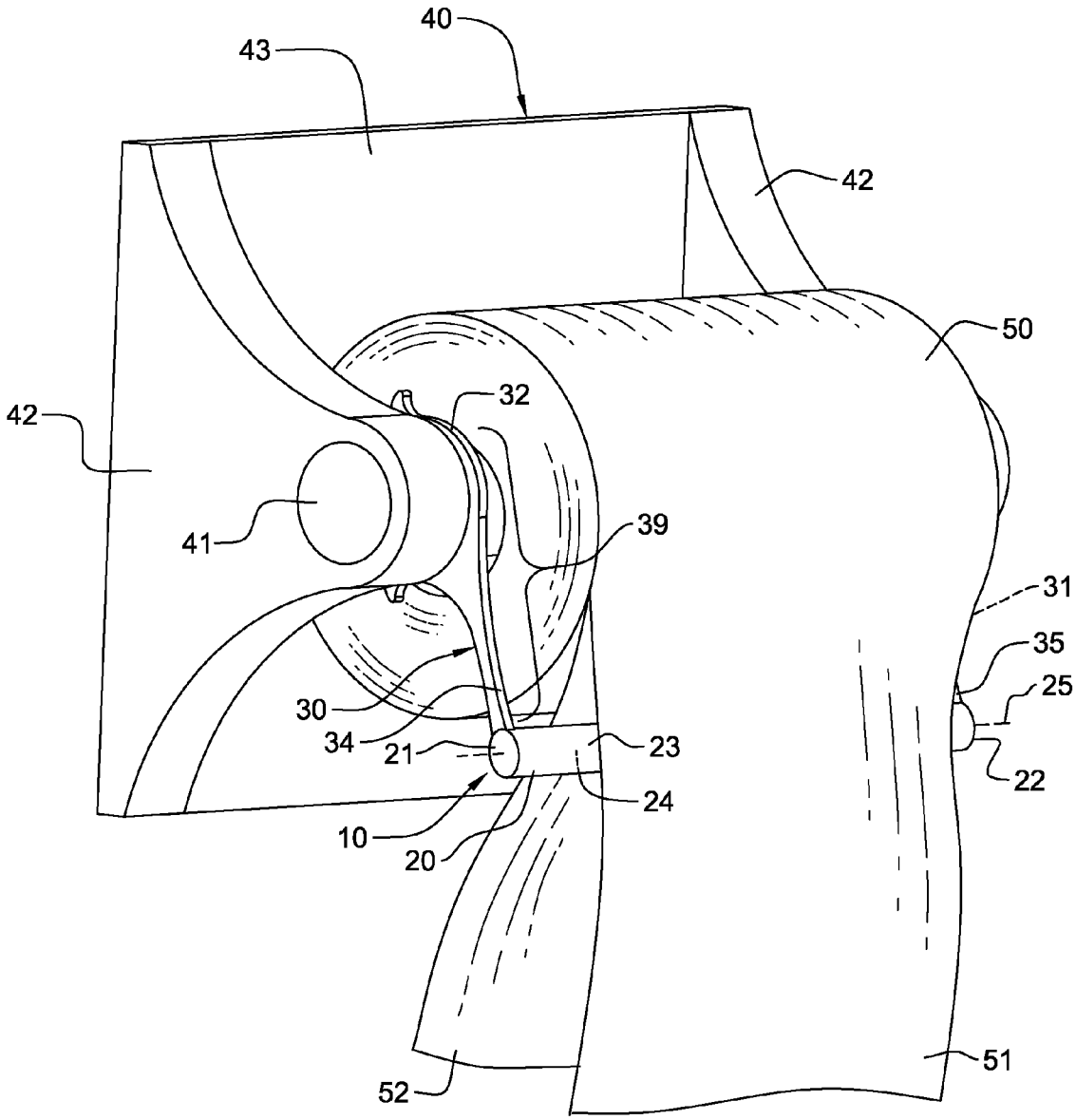
FIG. 1 is a perspective view of one embodiment of the multi-ply rolled paper separating device secured to a multi-ply rolled paper holder, with two arms coupled to the ends of the multi-ply rolled paper holder, in accordance with an aspect of the present invention.
Figure 2:
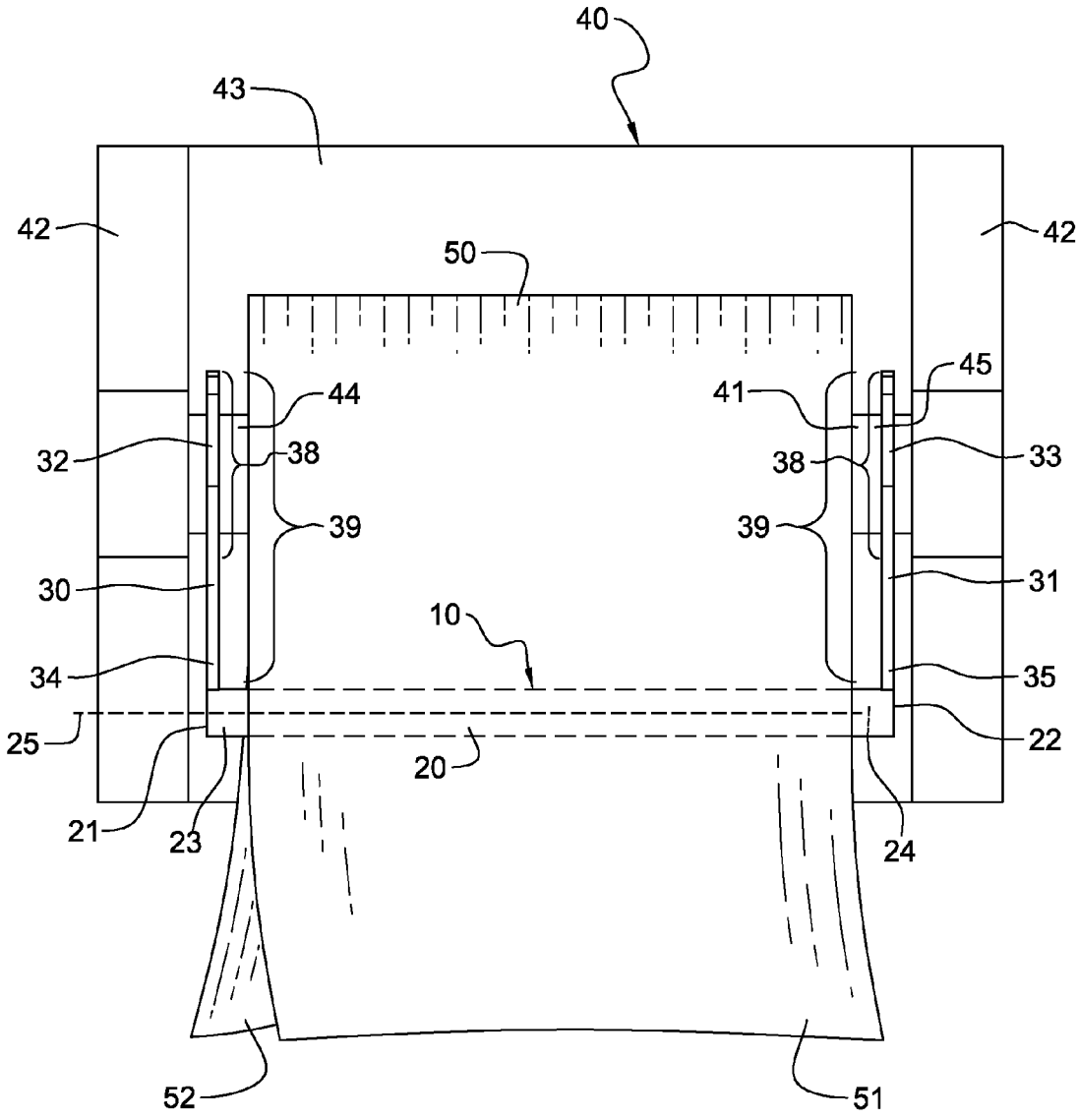
FIG. 2 is a frontal view of the multi-ply rolled paper separating device of FIG. 1 with two arms secured to the ends of the multi-ply rolled paper holder, in accordance with an aspect of the present invention.
Figure 3B:
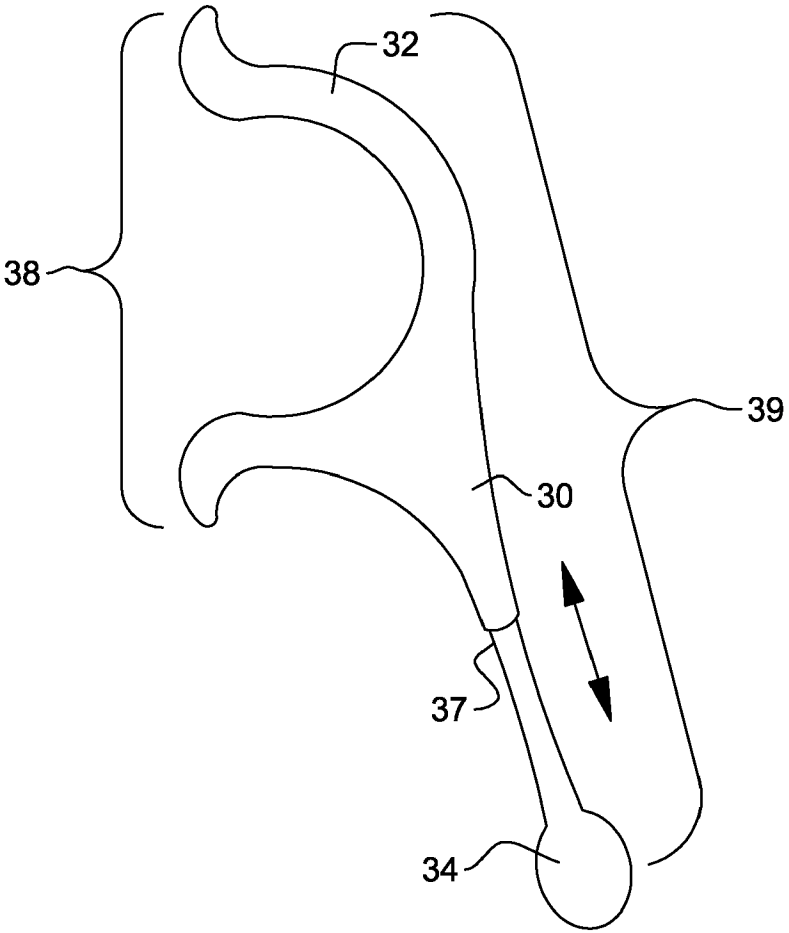
FIG. 3B is a side elevational view of one of the at least one arm of the multi-rolled paper separating device, showing the overall length of one of the at least one arm being adjustable by a telescoping mechanism, in accordance with an aspect of the present invention.
Figure 3A:
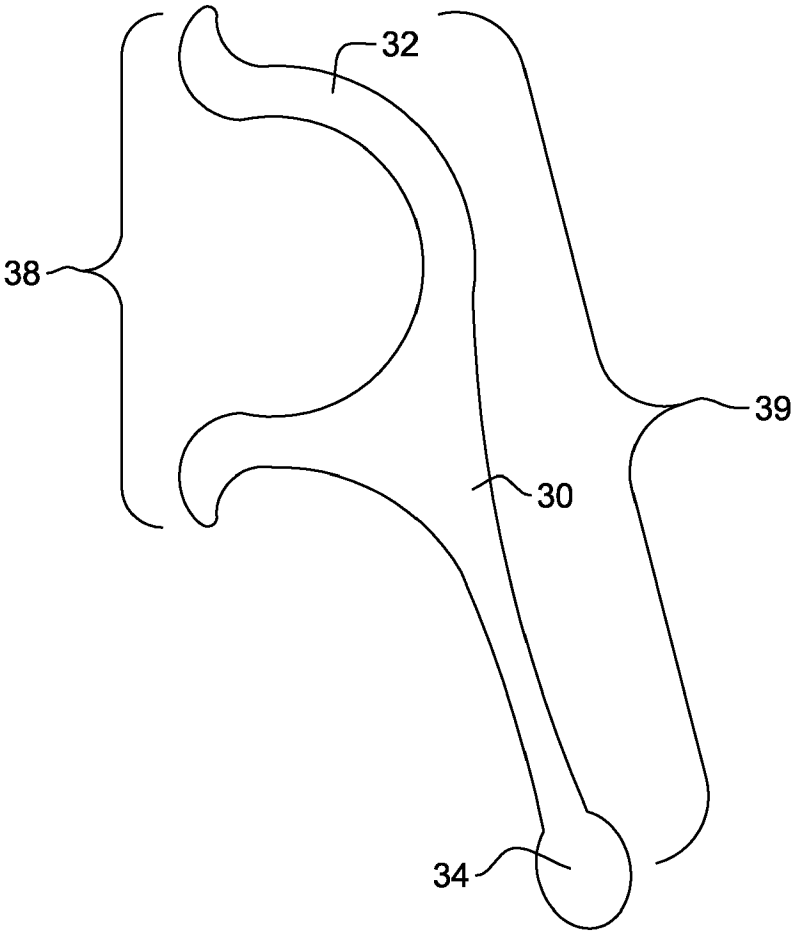
FIG. 3A is a side elevational view of one of the at least one arm of the multi-ply rolled paper separating device of FIG. 1, in accordance with an aspect of the present invention.
Figure 4:
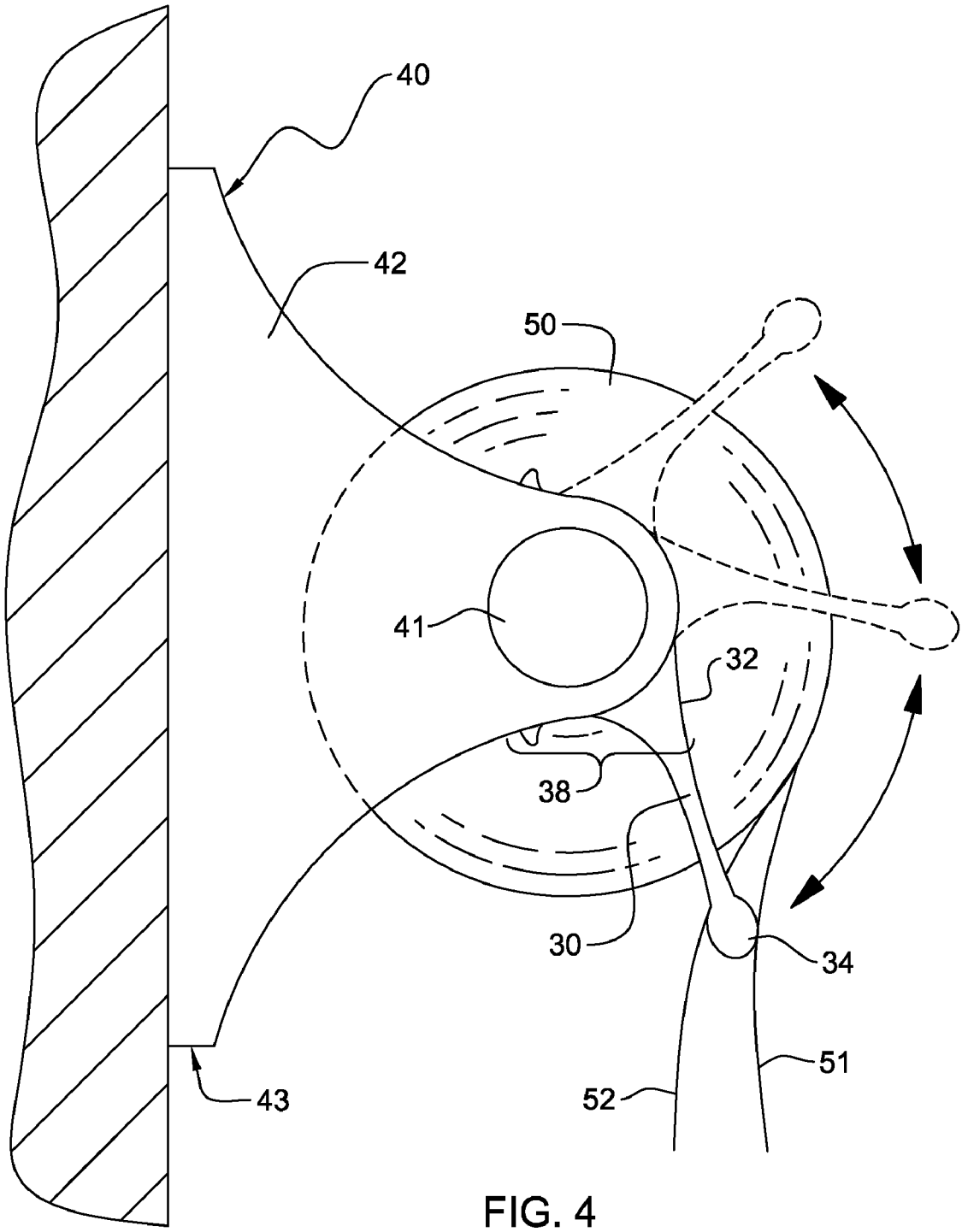
FIG. 4 is a side elevational view showing variable positioning of the at least one arm of the multi-ply rolled paper separating device of FIG. 1, while secured to the end of a multi-ply rolled paper holder, in accordance with an aspect of the present invention.

One embodiment of a multi-ply rolled paper separating device 10, embodying the principles and concepts of the present invention, is illustrated in FIGS. 1-4 and described below. FIGS. 1, 2 and 4 show one type of a conventional multi-ply rolled paper holder 40, with a wall plate 43, and which includes a longitudinal bar or dowel 41 that extends between a pair of side members 42 to hold a multi-ply rolled paper 50 in position for the user.

As illustrated in FIGS. 1 and 2, multi-ply rolled paper separating device 10 comprises at least one member 20 and at least one arm 30.

FIG. 1 shows multi-ply rolled paper separating device 10 secured to multi-ply rolled paper holder 40 and operating to divide multi-ply rolled paper 50 into separate plies 51, 52. As seen in FIG. 1, multi-ply rolled paper separating device 10 includes at least one member 20, having a first end 21 and a second end 22, a top surface 23 and an opposing bottom surface 24, and a longitudinal axis 25 that extends between first end 21 and second end 22, with top surface 23 and bottom surface 24 generally being parallel to longitudinal axis 25. In this embodiment, member 20 is shown in the shape of a rod or a dowel, however, member 20 may be constructed in various cross-sectional geometries, including polygonal, triangular, circular, oval, elliptical, rectangular, or square. Also to note, member 20 is shown to be an elongated structure, but member 20 may be of a number of structural configuration that allows member 20 to have substantial contact with the full width of multi-ply rolled paper 50 to facilitate the separation of the plies.

FIG. 1 further shows first end 21 of member 20 configured to couple to the lower end portion 34 of first arm 30. Second end 22 of member 20 is configured to connect to the lower end portion 35 of the second arm 31. As seen, ends 21, 22 may be connected to lower end portions 34, 35 by being fixed, wherein multi-ply rolled paper separating device 10 is manufactured to be a single unit. Other methods of connections, such as a spindle design to allow member 20 rotational movements relative to arms 30, 31 or a snap-on design, whereby member 20 snaps to fit into a groove at lower end portions 34, 35 and be stationary relative to arms 30, 31, are contemplated although not shown. In the depicted embodiment, multi-ply rolled paper separating device 10 comprises two arms 30, 31, but by no means are multiple arms required. Also in the shown embodiment, the overall length, length L 39, of first arm 30 and second arm 31 of multi-ply rolled paper separating device 10 is adjustable through a telescoping mechanism (see FIG. 3B), but other mechanisms, including a sliding configuration, are contemplated although not shown. First arm 30 and second arm 31 of multi-ply rolled paper separating device 10 may also be configured to be of a fixed length, as illustrated in FIG. 3A, such that each arm is set at a pre-determined length to accommodate various types and sizes of multi-ply rolled paper, including, but not limited to toilet paper and paper towel rolls.

The upper end portion 32 of first arm 30 and the upper end portion 33 of second arm 31 are configured to releasably connect and be secured to the two respective ends 44, 45 of multi-ply rolled paper holder bar 41. The securement mechanism 38 of upper end portions 32, 33 is configured to be releasable and removable, as illustrated in FIGS. 3A and 3B. Securement mechanism 38 as shown in FIGS. 3A and 3B is a spring clamp, but this mechanism may use a hook, a loop, a screw, a screw latch, a press fit, or a tension mount.

FIG. 2 shows the frontal view of one embodiment of multi-ply rolled paper separating device 10, coupled to ends 44, 45 of multi-ply rolled paper holder bar 41. As seen, multi-ply rolled paper holder bar 41 is oriented nearly parallel to longitudinal axis 25 of member 20.

FIGS. 1 and 2 further show the method of using multi-ply rolled paper separating device 10. Once multi-ply rolled paper 50 is placed in multi-ply rolled paper holder 40, multi-ply rolled paper separating device 10 is attached to multi-ply rolled paper holder bar 41 by two upper end portions 32, 33, using a releasable securement mechanism 38. Member 20 is located between the plies and acts as a barrier between the plies of multi-ply rolled paper 50 to physically separate the multi-ply paper into individual extended plies of paper. For example, in the FIGS. 1 and 2, a two-ply rolled paper product is separated into a first separated ply 51 and a second separated ply 52. The two-ply rolled paper is separated by pulling first separated ply 51 and second separated ply 52 against the longitudinal axis 25 of member 20 in generally a perpendicular direction. Member 20 serves as a dividing physical barrier between first separated ply 51 and second separated ply 52. First separated ply 51 passes over top surface 23 of member 20 and second separated ply 52 passes over bottom surface 24 of member 20. Although not shown, it is further contemplated that multiple members 20 may be attached to lower end portions 34, 35 to allow for ply separation of multi-ply rolled paper having greater than two plies. These members may be positioned adjacent or in parallel to each other to facilitate the separating functionality of multiple members 20.

FIGS. 3A and 3B are side elevational views of first arm 30 of the embodiment of multi-ply rolled paper separating device 10, of FIG. 1. FIG. 3A shows length L 39 of first arm 30 being of a fixed length. FIG. 3B shows length L 39 of first arm 30 being adjustable through a telescoping mechanism located in the middle portion 37 of first arm 30. As previously discussed, it should be understood to those skilled in the art that other adjustable mechanisms for changing length L 39 of arms 30, 31 are contemplated, including a sliding construct. In addition, although not shown, lower end portions 34, 35 may also be configured to allow for attaching multiple members 20 for use in separating multi-ply rolled paper having greater than two plies.

FIG. 4 is a side elevational view of multi-ply rolled paper separating device 10 and upper end portion 32 of first arm 30 showing the functionality of securement mechanism 38. It is contemplated that securement mechanism 38 will allow arms 30, 31 to be rotated and be positioned in several orientations relative to multi-ply rolled paper holder bar 41.

Although the preferred embodiments have been depicted and described in detail herein, it will be apparent to those skilled in the relevant art that various modifications, additions, and substitutions may be made without departing from the spirit of the invention and therefore, these are to be considered to be within the scope of the following claims.

What is claimed is:

1. A device for use in separating multi-ply rolled paper, the device comprising:

at least one member having a first end and a second end, a longitudinal axis, the longitudinal axis extending between the first end and the second end, and a top surface and a bottom surface, the top surface and bottom surface being parallel to the longitudinal axis;

at least one arm, having an upper end portion and a lower end portion, the lower end portion coupled to one of the first and second ends of the member and the upper end portion removably mounted to a multi-ply rolled paper holder bar formed in a multi-ply rolled paper holder; and wherein the at least one arm secures the at least one member at a distance from the multi-ply rolled paper holder so that when multi-ply rolled paper is positioned on the multi-ply rolled paper holder, the member is positioned below the height of the multi-ply rolled paper holder bar and divides the multi-ply rolled paper into separate plies by passing a first ply over the top surface and a second ply over the bottom surface of the member.

2. The device of claim 1, wherein the upper end portion of the at least one arm comprises a securement mechanism to couple the at least one arm to the multi-ply rolled paper holder.

3. The device of claim 2, wherein the securement mechanism is releasable.

4. The device of claim 1, wherein the at least one arm has a length L that is a fixed distance, extending from the upper end portion to the lower end portion.

5. The device of claim 1, wherein the length L of the at least one arm is adjustable to accommodate varying outer diameters of multi-ply rolled paper.

6. The device of claim 2, wherein the securement mechanism fixes the at least one arm at a set position relative to the end of the multi-ply paper holder.

7. The device of claim 2, wherein the securement mechanism allows for rotational movement of the at least one arm about the end of multi-ply rolled paper holder.

8. The device of claim 2, wherein the securement mechanism comprises one of a clamp, a hook, a loop, a screw, a screw latch, a press fit, or a tension mount.

9. The device of claim 4, wherein the at least one arm further comprises a telescoping mechanism to allow for adjustment of the length L.

10. The device of claim 4, wherein the at least one arm further comprises a sliding mechanism to allow for adjustment of the length L.

11. The device of claim 1, wherein the at least one member has a cross sectional geometric shape of at least one of a polygon, a triangle, a circle, an oval, an ellipse, a rectangle, and a square.

12. A method of separating plies for a multi-ply paper roll comprising:

coupling a member to at least one arm;

mounting the at least one arm to a multi-ply rolled paper holder bar formed in a multi-ply rolled paper holder, the member being disposed substantially parallel to and below the rolled paper holder bar, where the at least one arm may be subsequently removed;

drawing the multi-ply paper from the multi-ply rolled paper holder; and passing at least one of the plies over the member and the remaining plies under the member to separate the at least one ply from the remaining plies.

* * * * *